United States Patent [19]

Nailor, III

[11] 4,024,953

[45] May 24, 1977

[54] BATTERY SNAP TERMINAL

[75] Inventor: William Kirby Nailor, III, Mechanicsburg, Pa.

[73] Assignee: E. I. Du Pont de Nemours and Company, Wilmington, Del.

[22] Filed: June 18, 1976

[21] Appl. No.: 697,549

Related U.S. Application Data

[62] Division of Ser. No. 626,030, Oct. 28, 1975, Pat. No. 3,980,388.

[52] U.S. Cl. ..... 206/344; 206/330; 206/820; 339/228

[51] Int. Cl.[2] ..... B65D 85/00

[58] Field of Search ... 206/328, 330, 333, 342–344, 206/484, 526, 820; 339/36, 226, 228, 256 RT

[56] References Cited

UNITED STATES PATENTS

| | | | |
|---|---|---|---|
| 2,766,510 | 10/1956 | Heibel | 206/330 X |
| 2,901,526 | 8/1959 | Huntley et al. | 339/228 X |
| 3,361,251 | 1/1968 | Olsson | 206/330 |
| 3,372,797 | 3/1968 | Grevich | 206/820 X |
| 3,650,706 | 3/1972 | Parsons | 206/330 X |
| 3,920,121 | 11/1975 | Miller | 206/330 |

*Primary Examiner*—Steven E. Lipman

[57] ABSTRACT

A battery terminal includes a ring and a plurality of upstanding fingers extending inwardly of the ring. Each finger includes an inwardly and outwardly-directed shoulder. The inwardly-directed shoulders are engageable with a male battery terminal and the outwardly-directed shoulders are engageable with a female battery terminal. Also, a polarizing shroud is provided having an opening to the inwardly-directed shoulders of the terminal or an opening to the outwardly-directed shoulders to provide the required polarization.

2 Claims, 6 Drawing Figures

BATTERY SNAP TERMINAL

This is a division of application Ser. No. 666,030, filed Oct. 28, 1975, and now U.S. Pat. No. 3,980,388.

BACKGROUND OF THE INVENTION

1. Field of the Invention

The present invention relates to battery terminals and particularly relates to battery snap terminals which are useful for engaging a male or female battery terminal and apolarizing shroud for such terminals.

2. Description of the Prior Art

Removably engageable or snap terminals for dry cell batteries are well known in the prior art. Generally, dry cell batteries have male and femal polarized terminals and require a femal and male snap terminal, respectively, for engaging each such battery terminal and connecting the battery to a load. Generally, such snap terminals have been manufactured as either a male terminal or a femal terminal. Such terminals are generally manufactured by standing the terminals from motal stock with a separate die required from the male and femal terminal. The present invention provides a hemaphroditic snap-type terminal which may be engaged with either a male or female battery terminal thus climinating the requirement for a separate die for manufacturing each terminal. A polarizing shroud provides the required polarization for the snap terminals.

SUMMARY OF THE INVENTION

According to the present invention, a battery snap terminal engageable with a male or female battery terminal is provided comprising a ring having a plurality of inclined fingers extending inwardly of the ring, each finger including a first shoulder directed inwardly within the ring and a second shoulder directed outwardly within the ring, the first shoulders being annularly disposed about a central axis of the ring a first radial distance from the axis, and the second shoulder being annularly disposed about the axis of the ring a radial distance greater than the first shoulders. Preferably, the snap terminal of the invention includes a polarizing shroud having an opening to the inwardly directed shoulders or an opening to the outwardly directed shoulders to provide polarization for the terminal.

Additionally, according to the present invention, a package of terminals having a polarizing shroud is provided in strip form comprising first and second strips of insulating material, and a plurality of terminals according to the invention disposed between the strips of insulating material, each strip of insulating material including a plurality of openings alternately spaced to provide a polarizing shroud for each terminal.

The battery snap terminals of the present invention provide for reliably removably connecting a wire to either a male or femal battery terminal. The hemaphroditic charactor or the terminal eliminates the requirement for separate dies for male and female terminals and contributes to reducing the manufacturing cost of such terminals. Additionally, the shroud provides the required polarization, and the package of alternately-polarized male and female snap terminals provides a convenient inventory of male and female terminals.

DETAILED DESCRIPTION OF PREFERRED EMBODIMENT

Figures 1, 2, 3, 4, 5, 6:
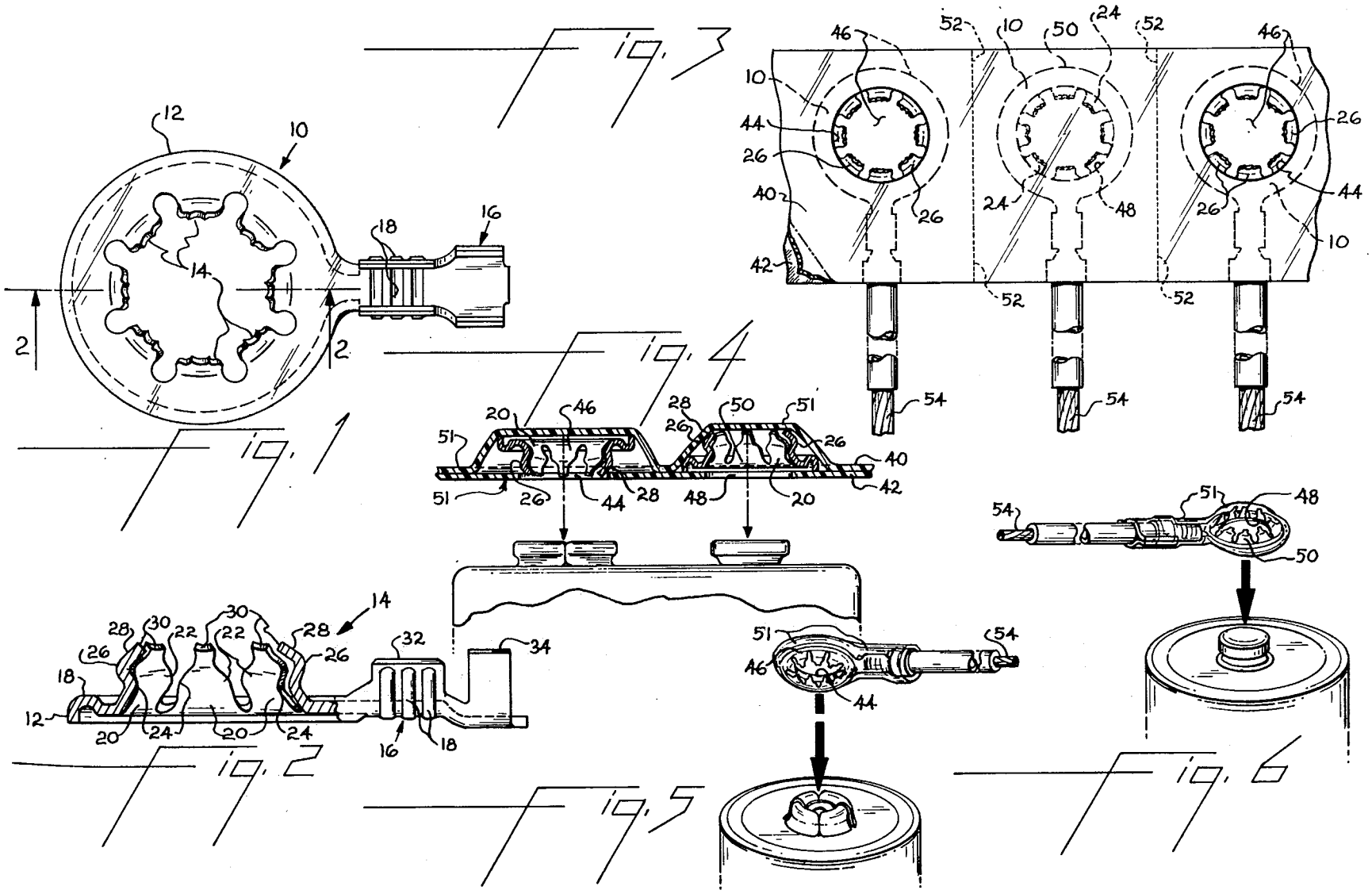
FIG. 1 is a plan view of an embodiment of a snap terminal of the invention.
FIG. 2 is a side view in partial section along line 2—2 of the embodiment of the terminal of FIG. 1.
FIG. 3 is a plan view of an embodiment of a package of snap terminals of the invention.
FIG. 4 is a sectional view through a pair of snap terminals shown opposite a battery having adjacent male and female terminals.
FIG. 5 is a side view illustrating the use of a polarized snap terminal of the invention with a female battery terminal.
FIG. 6 is a side view illustrating the use of a polarized snap terminal of the invention with a male battery terminal.

A snap terminal including a polarizing shroud and a package of such snap terminals are described below with reference to the attached drawings wherein the same numerals are used throughout to illustrate the same elements.

With particular reference to FIGS. 1 and 2, a snap terminal 10 according to the present invention comprises a ring 12, a plurality of inwardly directed inclined fingers 14 and a crimp barrel 16 for attaching the terminal 10 to a wire.

The ring 12 includes an annular, embossed rib 18 and the fingers 14 are integrally formed with the ring 12. Each finger 14 includes a tapered segment 20 extending inwardly toward a central axis of the ring inclined at a 45° angle, a transition segment 22 including a first inwardly directed shoulder 24 and a second outwardly directed shoulder 26, and an end segment 28 terminating in a free end 30. The inwardly directed shoulders 24 are annularly disposed about a central axis of the ring 12 a first radial distance from the central axis, and the outwardly directed shoulders 26 are annularly disposed about the central axis a radial distance greater than the inwardly directed shoulders. The crimp barrel 16 includes a wire crimp barrel 32 and an insulating crimp barrel 34.

The snap terminals 10 of the invention may be formed from metal strip stock, e.g. bronze, by die-stamping and may include a conventional carrier strip (not illustrated) for transporting the terminals from the die and for reeling and feeding the terminals.

With particular reference to FIG. 3, a package according to the invention comprises a plurality of terminals disposed between first and second strips 40, 42 of the insulating material. The first strip of insulating material 40 includes alternately spaced openings 44 which open onto the outwardly directed shoulder 26 of alternately spaced terminals 10 to provide male polarized snap terminals 46. The second strip of insulating material 42 includes alternately spaced openings 48 (one shown) which open into the inwardly directed shoulders 24 to provide female polarized snap terminals 50. The insulating strips 40, 42 include transverse perfor perforations 52 for readily separating the male polarized terminals 46 and female polarized terminals 50.

The insulating strips 40, 42 may be any suitable insulating material, e.g. polypropylene, and may be either heat sealed or sealed by use of an adhesive. The package including the terminals 10 may be preloaded with wires 54 in the crimp barrels 16, as illustrated, or may be supplied with the crimp barrels ready for receiving a wire.

A pair of male and female terminals 46, 50 may be encased in a suitable insulated shroud 51, as illustrated in FIG. 4, for use with a battery having male and female terminals at one end. In use, the male polarized terminal 46 is engaged with a female battery terminal with the free ends 30 of fingers 14 inside the rim of the female terminal and pressed to snap the outwardly directed shoulders 26 on the fingers 14 in engagement with the interior rim of the female terminal. Similarly, the female polarized terminal 50 is positioned over a male terminal on a battery with tapered segment 20 over the male terminal and pressed to snap the inwardly directed shoulders 24 of fingers 14 over the rim of the male terminal.

The male polarized snap terminal 46 or female polarized terminal 50 may be used for connecting a load to a battery as illustrated in FIGS. 5 and 6, respectively. Alternatively, a terminal 46 can be mated with a terminal 50.

What is claimed is:

1. A package of battery snap terminals comprising first and second strips of insulating material, a plurality of battery snap terminals disposed between the strips of insulating material, each battery terminal comprising a ring having a plurality of inclined fingers extending inwardly of said ring, each finger including a first shoulder directed inwardly of said ring and a second shoulder directed outwardly of said ring, and each strip of insulating material including a plurality of openings alternately spaced with regard to said terminals to correspond with the inwardly directed shoulders and outwardly directed shoulders on alternate terminals.

2. A package, as recited in claim 1, said strips of insulating material including transverse perforations between each terminal.

* * * * *